United States Patent [19]

Takagi et al.

[11] Patent Number: 4,744,231

[45] Date of Patent: May 17, 1988

[54] CLOSURE LOCK SYSTEM

[75] Inventors: Kazumasa Takagi, Yokohama; Haruo Mochida, Kanagawa, both of Japan

[73] Assignee: Nissan Motor Co., Ltd., Yokohama, Japan

[21] Appl. No.: 456,252

[22] Filed: Jan. 6, 1983

[30] Foreign Application Priority Data

Jan. 14, 1982 [JP] Japan ..... 57-4604

[51] Int. Cl.[4] ..... E05B 47/00; E05B 65/36

[52] U.S. Cl. ..... 70/264; 70/276; 70/413; 307/309

[58] Field of Search ..... 292/201, 251.5; 70/264, 70/413, 276, 256, 257, 277, 279; 335/205; 307/309, 10 AT; 328/5; 200/61.62, 61.64, DIG. 2, 43.04; 49/20, 395; 343/901, 903

[56] References Cited

U.S. PATENT DOCUMENTS

| | | | |
|---|---|---|---|
| 1,997,155 | 4/1935 | Sprecker | 70/264 |
| 2,236,043 | 3/1941 | Tracy | 70/264 |
| 2,459,029 | 1/1949 | Ingres et al. | 70/264 |
| 2,802,357 | 8/1957 | Smith | 70/264 |
| 2,852,927 | 9/1958 | McCurdy | 70/264 |
| 3,386,761 | 6/1968 | Johnstone et al. | 292/201 |
| 3,427,832 | 2/1969 | Planer | 70/264 |
| 3,653,237 | 4/1972 | DuRocher | 70/264 |
| 3,751,088 | 8/1973 | Schlage et al. | 292/201 |
| 3,751,950 | 8/1973 | Leger et al. | 292/201 X |
| 3,881,077 | 4/1975 | Piber | 200/61.69 |
| 3,937,976 | 2/1976 | McGuirk | 307/10 AT |
| 3,989,287 | 11/1976 | Sheesley | 292/201 |
| 4,114,412 | 9/1978 | Braatz | 70/DIG. 49 X |
| 4,205,328 | 5/1980 | Gotanda | 335/205 X |
| 4,222,034 | 9/1980 | Orenzow | 180/287 X |
| 4,232,819 | 11/1980 | Bost | 70/413 X |
| 4,252,351 | 2/1981 | Yoshino et al. | 292/336.3 |
| 4,319,712 | 3/1982 | Bar | 335/205 X |
| 4,366,466 | 12/1982 | Lutz | 307/10 AT X |
| 4,603,563 | 8/1986 | Mochida et al. | 70/276 |

FOREIGN PATENT DOCUMENTS

| | | | |
|---|---|---|---|
| 0105139 | 4/1984 | European Pat. Off. | 70/276 |
| 2163573 | 12/1971 | Fed. Rep. of Germany . | |
| 2702883 | 1/1977 | Fed. Rep. of Germany . | |
| 3005890 | 2/1980 | Fed. Rep. of Germany . | |
| 2406547 | 6/1979 | France | 70/276 |
| 0051621 | 4/1977 | Japan | 292/201 |
| 1528569 | 10/1978 | United Kingdom . | |
| 1576318 | 10/1980 | United Kingdom | 70/276 |
| 0918412 | 4/1982 | U.S.S.R. | 70/276 |

*Primary Examiner*—Lloyd A. Gall

*Attorney, Agent, or Firm*—Foley & Lardner, Schwartz, Jeffery, Schwaab, Mack, Blumenthal & Evans

[57] ABSTRACT

A closure lock system comprising a lock assembly, a lock actuator for locking or unlocking the lock assembly and a lock circuit including a reed switch which when closed by a magnet of a key causes the lock actuator to lock the lock assembly.

15 Claims, 5 Drawing Sheets

CLOSURE LOCK SYSTEM

BACKGROUND OF THE INVENTION

The present invention relates to a closure lock system for an automobile.

A conventional closure lock system is explained taking an automobile door lock system for an example. Commonly, the door lock system comprises a door lock assembly, a lock knob and a key cylinder. One type of door lock system is designed such that manipulating the lock knob will lock the lock assembly, whereas turning the key cylinder with a key will unlock the latter. In another type of door lock system, lock actuators are operatively connected to lock assemblies of all of the doors of an automobile to lock or unlock all the doors at the same time. In these door lock systems, when the door is to be locked from the outside of the vehicle, a key has to be inserted into the key cylinder or a lock knob has to be pressed to a lock position thereof and then the door has to be closed with an outside handle held in a raised position thereof. The latter locking operation is hereinafter referred to as a keyless locking operation.

However, with the above-mentioned door lock systems, since the key has to be inserted into the key cylinder on unlocking the door from the outside of the vehicle, once all of the doors are locked by the keyless locking operation with the key left inside of the vehicle, no one can unlock the doors until a spare key becomes available.

SUMMARY OF THE INVENTION

An object of the present invention is to provide a closure lock system wherein a locking operation is effected from the outside of an automobile without inserting a key into a key cylinder and wherein a safeguard is provided against inadvertent locking of the doors when the key is left inside the vehicle.

According to the present invention, a closure lock system comprises a lock assembly, a lock actuator for locking or unlocking the lock assembly and a lock circuit for actuating the lock actuator, wherein the lock circuit has a reed switch which when actuated by a magnet mounted on a key or a key holder belonging to the key allows the lock actuator to lock the lock assembly.

DESCRIPTION OF THE PREFERRED EMBODIMENTS

Referring to FIGS. 1 through 5, and 8 through 11, the first embodiment is hereinafter explained.

Figure 1:
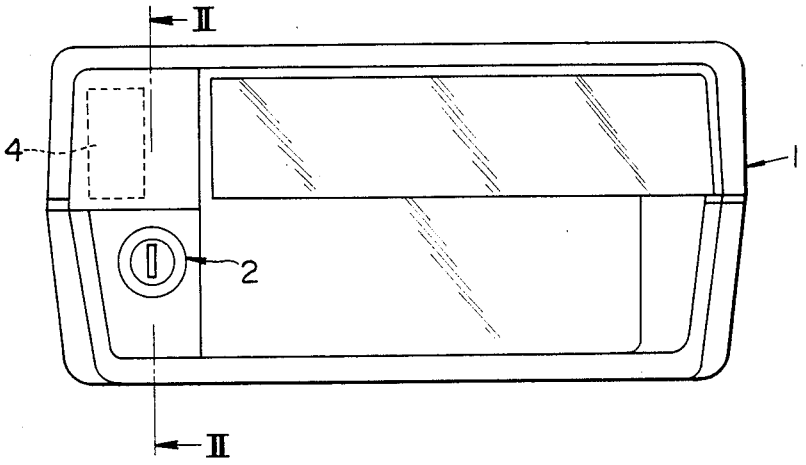
FIG. 1 is a front view of an outside handle of an escuctheon of an automobile door.
Figure 2:
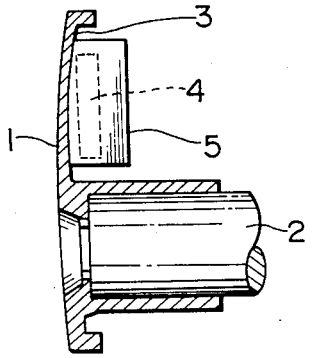
FIG. 2 is a cross sectional view through the line II—II in FIG. 1.
Figure 8:
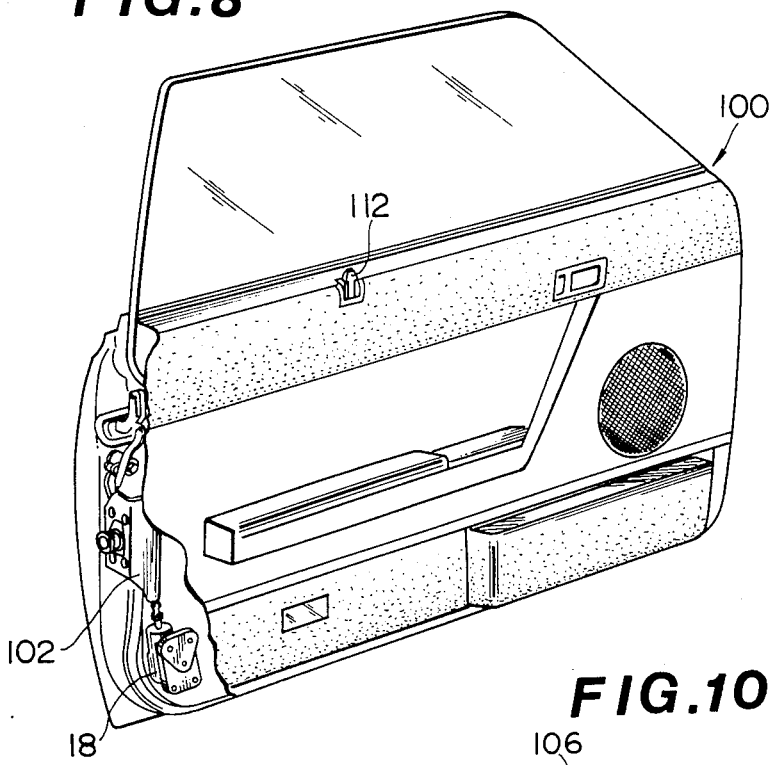
FIG. 8 is a perspective view of the automobile door partly broken away to show a lock assembly and a solenoid actuator operatively connected thereto.

Referring to FIGS. 1 and 2, there is shown an escutcheon 1 of an outside handle of an automobile door 100 (see FIG. 8). The escutcheon 1 has received therein a key cylinder 2 of a lock assembly 102 (see FIG. 8). A reed or lock switch 4 is mounted within a casing 5 fixedly attached to the inside surface 3 of the escutcheon 1 as best seen in FIG. 2. The reed switch 4 is electrically circuited with door lock actuators 18 mounted to all of the automobile doors, respectively.

Figure 3:
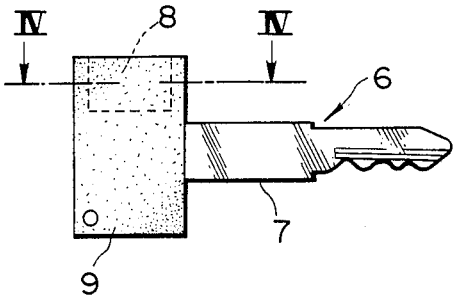
FIG. 3 is a plane view of a key.
Figure 4:
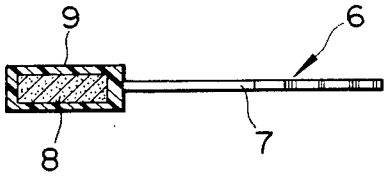
FIG. 4 is a cross sectional view through the line IV—IV in FIG. 3.

Referring also to FIGS. 3 and 4, there is shown a key 6 which cooperates with the key cylinder 2 for locking or unlocking the lock assembly 102. The key 6 comprises a tip portion 7 which is designed to be inserted into the key cylinder 2 and a head portion 9. The head portion 9 is made of vinyl chloride and receives therein a magnet 8 which is adapted to close the reed switch 4.

Figure 5:
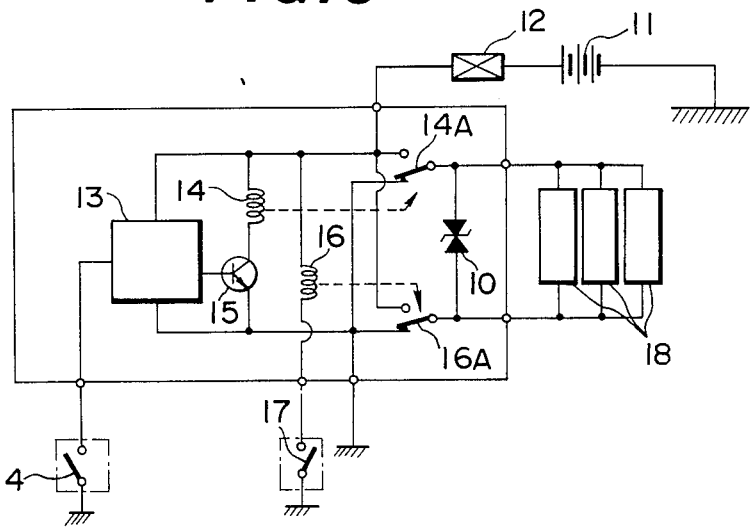
FIG. 5 is a circuit diagram used in a first embodiment of a closure lock system according to the present invention.

As shown in the lock circuit in FIG. 5, the reed switch 4 is connected with the associated circuit component parts. The lock circuit has a battery 11, a fuse 12, a timer 13, a relay coil 14, a relay switch 14A, a transistor 15, and a plurality, three in this embodiment, of lock actuators 18, each in the form of a solenoid actuator. When the reed switch 4 is closed, the timer 13 supplies base current to the transistor 15 for a predetermined period of time. The lock circuit also includes a relay coil 16, a relay switch 16A and an unlock switch 17 in the form of a lock knob switch which will be described later in connection with FIGS. 8 through 11. In the state illustrated in FIG. 5, the relay switch 14A is connected to the ground side, grounding one of each of the solenoid actuators 18, and the other relay switch 16A is connected to the ground side, too, grounding the opposite of each of the solenoid actuators 18. When the relay switch 14A is connected to the battery side, current flows through the solenoid actuators 18 in one direction, locking the associated lock assemblies 102. When the other relay switch 16A is connected to the battery side with the one relay switch 14A being connected to the ground side, current flows through the solenoid actuators 18 in the opposite direction, unlocking the associated lock assemblies 102. The reference numeral 10 designates a bidirectional zener diode which is electically circuited to absorb reverse electromotive force created by the solenoid actuators 18.

Figure 10:
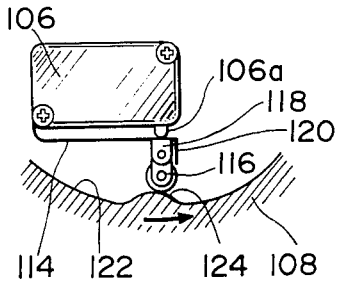
FIGS. 10 and 11 are diagrammatic views showing the operation of the lock knob switch.
Figure 11:
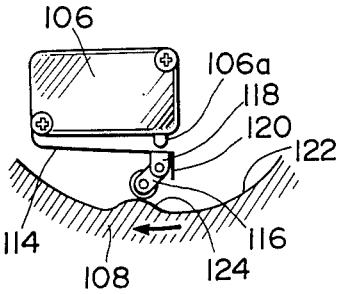

Referring to FIGS. 8 through 11, the lock knob switch 17 is described which comprises a housing 104 having mounted therein a microswitch 106 and a pivoted rotor 108 which is pivotable by a shaft 110 operatively linked with a lock knob 112 (see FIG. 8). The microswitch 106 has its contacts connected between the relay coil 16 and ground as shown in FIG. 5. The microswitch 106 is closed or makes its contacts when an actuator pin **106*a* thereof is pressed by a free end of a springy plate 114. The springy plate 114 has an opposite end fixed to the casing of the microswitch 106. A caster 116 is pivoted to a bracket 118 fixed to the free end of the springy plate 114 as best seen in FIGS. 10 and 11**.

The springy plate 114 is bent outwardly away from the casing of the microswitch 106 to form a stop portion 120 adapted to abut with the caster 116. The wheel of the caster 116 runs on a cam surface 122 of the rotor 108 having a projection 124. As will be understood from the following description in connection with the operation of the lock knob switch 17, the springy plate 114, caster 116 and stop portion 120 cooperate with each other to form a one-way mechanism.

Figure 9:
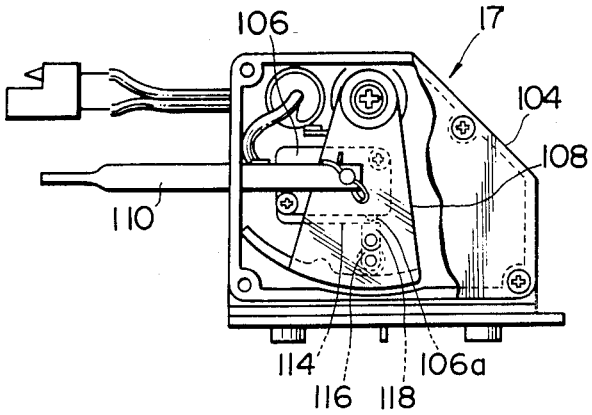
FIG. 9 is a partly sectional side view of a lock knob switch.

The lock knob switch 17 operates as follows: When the lock knob 112 (see FIG. 8) is pulled from a lock position thereof to an unlock position thereof, the shaft 110 is moved to the right, pivoting the rotor 108 counterclockwise from a first position thereof as illustrated in FIG. 9 to a second position thereof not illustrated. During this counterclockwise pivotal movement, the caster 116 goes up the projection 124 from the right side thereof and down to the left side thereof viewing in FIG. 10. The caster 116 is able to push up the free end of the springy plate 114 to press the pin 106*a* when the caster 116 is disposed on the projection 124 because the caster 116 abuts with the stop portion 120 and is prevented from tilting as shown in FIG. 10. When it assumes the second position, the caster 116 is not disposed on the projection 124, causing the microswitch 106 to break its contacts. When the lock knob 112 is pressed down from the unlock position thereof to the lock position thereof, the shaft 110 is moved to the left to the illustrated position in FIG. 9, pivoting the rotor 108 clockwise to the illustrated first position. During this clockwise pivotal movement of the rotor 108, the caster 116 goes up the projection 124 from the left side thereof and down to the right side thereof viewing in FIG. 11. However, the caster 116 does not push up the free end of the springy plate 114 because the caster tilts as it goes past the projection 124 as seen in FIG. 11.

The operation of the first embodiment described in connection with FIGS. 1 to 5, and 8 to 10 is explained hereinafter.

On locking the doors 100 from the outside of the automobile after a driver has parked the vehicle, what he or she has to do is to let the head portion 9 of the key 6 approach the reed switch 4 of the escutcheon 1, closing the reed switch 4. When the reed switch 4 is closed by the magnet 8, the timer 13 is activated to allow base current to flow through the transistor 15 for the predetermined period of time, rendering the transistor 15 conductive, allowing current to flow through the relay coil 14. When the relay coil 14 is energized, the relay switch 14A is connected to the battery 11 side, allowing current to flow via the relay switches 14A and 16A through door lock solenoids 18 in the direction as to lock the associated lock assemblies 102. Without any difficulty, the doors are locked from the outisde of the vehicle in this manner. This does not require a complicated operation of inserting the tip portion 7 of the key 6 into the key cylinder 2. Besides, there is provided a safeguard against a driver's leaving the key plate 6 inside the vehicle because the doors 100 are not locked without the key 6.

On unlocking the doors 100 from the outside of the vehicle, the tip portion 7 of the key 6 has to be inserted into the key cylinder. When the doors 100 are to be unlocked from the inside of the vehicle, the lock knob 112 is pulled up from the lock position thereof to the unlock position thereof, closing the unlock switch 17, allowing current to flow from the battery 11 to the relay coil 16, connecting the relay switch 16A to the battery 11 side. This causes current to flow through the lock solenoid actuators 18 in the opposite direction as to unlock the door lock assemblies 102.

Figure 6:
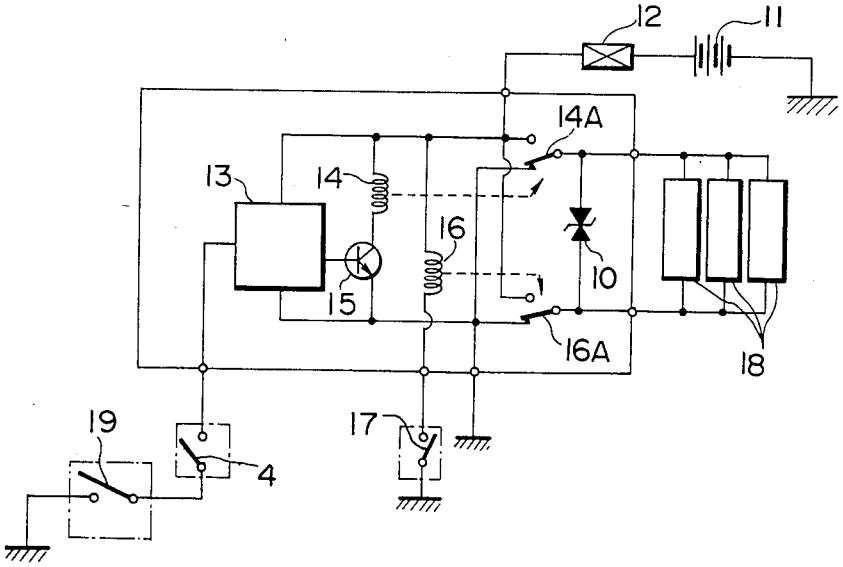
FIGS. 6 and 7 are similar circuit diagrams showing second and third embodiments of a closure lock system according to the present invention.

Referring to FIG. 6, the second embodiment is described. The second embodiment is different from the first embodiment only in that a reed switch 4 has connected in series thereto a function switch in the form of a key detecting switch 19. The key detecting switch 19 remains open as long as the key 6 is left inserted into an ignition key cylinder disposed inside the vehicle. Owing to the provision of the switch 19, even if a driver happens to let another magnet approach the reed switch 4 of the door 100, the doors 100 will not be locked as long as the key 6 is left inserted into the ignition key cylinder, not illustrated. Thus, this arrangement is effective to prevent the doors 100 from being locked with the key 6 confined within the vehicle.

The function switch 19 may take the form of a door switch that detects a half closed state of the associated door or doors. In this case, the doors are not locked until the doors are completely closed. Alternatively, a warning device may be provided which produces a warning signal when the door or doors remain half closed.

Figure 7:
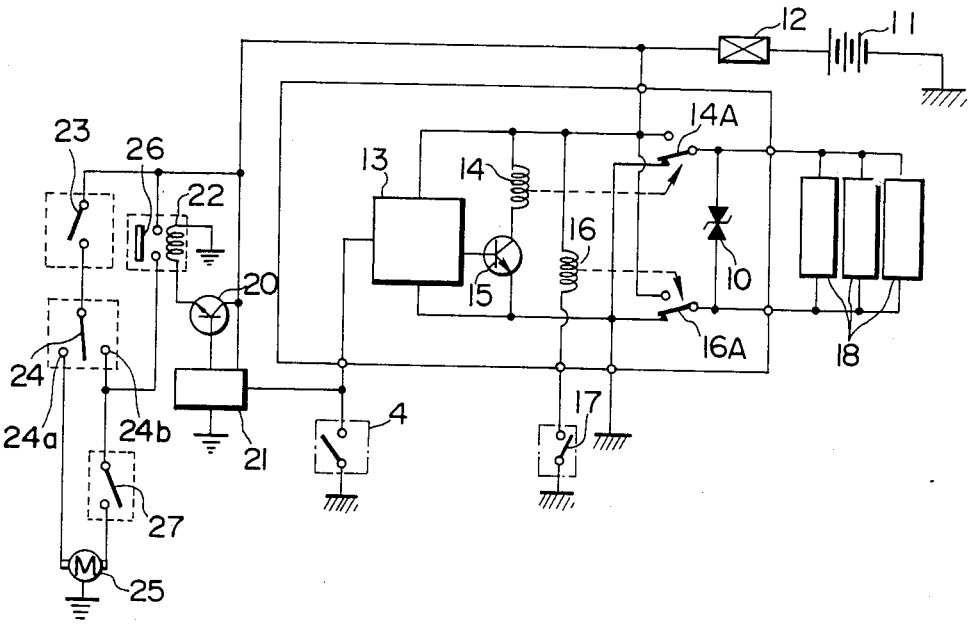

Referring to FIG. 7, a third embodiment is explained. The third embodiment is different from the first embodiment in the provision of an antenna control circuit which causes a power assisted antenna device to store the antenna upon locking the doors 100 with the magnet 8 of the key 6. By virtue of such antenna control circuit, a driver is relieved from an operation of inserting the key into the ignition key cylinder and manipulating an up-down switch of the power assisted antenna to store the antenna when he or she notices that the antenna is left unstored upon leaving the vehicle. The ordinary power assisted antenna device is designed to be put into an operable state when the ignition switch is turned on. Storing the antenna upon leaving the vehicle is desirable because if the driver leaves the vehicle with the antenna left unstored, it may happen that the antenna is broken by mischief.

Figure 12:
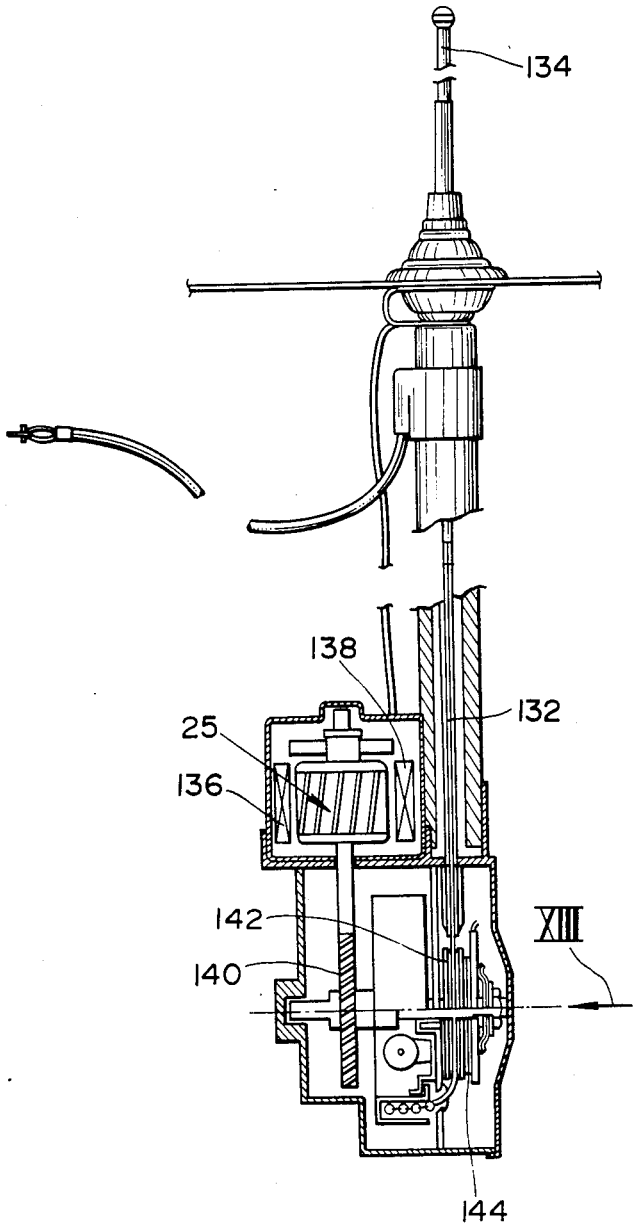
FIG. 12 is an end sectional view of a power unit of a power assisted antenna device.
Figure 13:
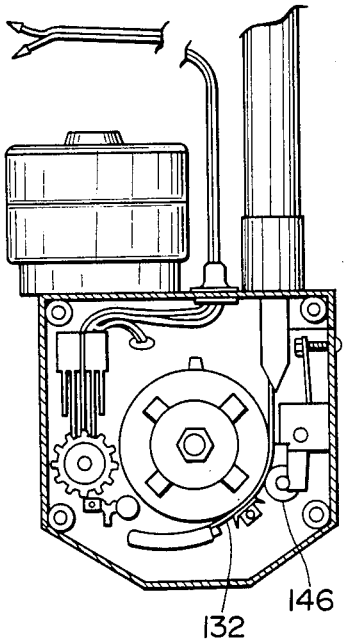
FIG. 13 is a front view of the power unit of the power assisted antenna device.

Referring to FIGS. 12 and 13, the power assisted antenna device is briefly explained. In the power assisted antenna device, a torque produced by a reversible electric motor 25 is transmitted via a nylon wire 132 to an antenna pole 134. The reversible motor 25 has two field coils 136, 138 and a shaft with a worm thereon meshing with a nylon gear 140 to transmit motor torque thereto. The nylon gear 140 has rotatable therewith a pulley 142 having a groove which the nylon wire 132 is disposed in. A clutch 144 is provided which allows the pulley 142 to slip when an excessively large force is applied to the motor 25. The nylon wire 132 is pressed against the pulley groove by a roller 146. The nylon wire 132 extends toward the antenna pole 134 and is fixed thereto to pull the antenna pole 134 down or push same up. Referring also to FIG. 7, the reversible motor 25 is diogrammatically illustrated. The motor 25 rotates forwardly when the up-down control switch 24 is connected to an up contact 24a. The forward rotation of the motor 25 causes the nylon gear 140 and pulley 142 to turn in a direction to send the nylon wire 132 upwardly to push the antenna pole 134 up. When the up-down control switch 24 is connected to a down contact 24b thereof which is connected to the motor 25 via a limit switch 27, the motor 25 rotates in the reverse direction to let the pulley wind the nylon wire, pulling the antenna pole 134 down. The up-down control switch 24 is connected in series with an ignition switch 23. The antenna control circuit comprises a timer 21 which is adapted to supply base current to a transistor 20 for a predetermined period of time upon a reed switch 4 being closed, a relay coil 22 connected in series with the transistor 20, and a relay switch 26 connected in series with the limit switch 27 but connected in parallel with the ignition switch 23 and up-down switch 24 as seen in FIG. 7. The limit switch 27 is provided to prevent the occurrence of clutch noise which otherwise would occur after the antenna pole 134 has been pulled down to a stored position thereof until the timer 21 ceases its operation.

In this circuit arrangement, the timer 21 is actuated upon closing of the reed switch 4 to render the transistor 20 conductive for the predetermined period of time, supplying current to the relay coil 22, thus closing the relay switch 26 to supply current to the motor 25 via the limit switch 27, allowing the reverse rotation of the motor 25, pulling the antenna pole 134 down.

What is claimed is:

1. A closure lock system comprising:

a vehicle door;

a lock assembly including a key cylinder mounted to said vehicle door;

a lock actuator operatively connected with said lock assembly for locking or unlocking said lock assembly;

a lock circuit including a reed switch operatively connected with said lock actuator, said reed switch being mounted inside of said door near a predetermined external portion of said door;

a key including a portion insertable into said key cylinder for locking or unlocking said lock assembly; and a magnet mechanically connected to a non-insertable key head portion of said key, said magnet being operative to actuate said reed switch when it approaches said predetermined external portion of said door from outside of said vehicle.

2. A closure lock system as claimed in claim 1, wherein said lock actuator is in the form of a solenoid actuator.

3. A closure lock system as claimed in claim 2, wherein said lock circuit includes a battery, a relay switch connected in series with one terminal of said solenoid actuator, and a relay coil, said relay switch being normally connected to the ground and being connectable to said battery when current is supplied to said relay coil, and said lock circuit also includes means for supplying current to said relay coil when said reed switch is closed.

4. A closure lock system as claimed in claim 3, wherein said lock circuit includes a second relay switch connected in series with the other terminal of said solenoid actuator, a second relay coil and an unlock switch connected in series with said second relay coil, said second relay switch being normally connected to the ground and being connectable to said battery when current is supplied to said second relay coil, said unlock switch supplying current to said second relay coil when said unlock switch is closed.

5. A closure lock system as claimed in claim 1, wherein said lock circuit includes a function switch connected in series with said reed switch.

6. A closure lock system as claimed in claim 5, wherein the function switch is in the form of a key detecting switch which remains open as long as said key is inserted into an ignition key cylinder.

7. A closure lock system as claimed in claim 5, wherein said function switch is in the form of a door switch which remains open until the associated door is completely closed.

8. A closure lock system as claimed in claim 1, including a power assisted antenna device having an antenna pole and means for causing said power assisted antenna device to pull down the antenna pole to a stored position thereof in response to closing of said reed switch.

9. In a vehicle, a combination comprising;

a door;

a lock assembly including a key cylinder mounted to the door;

a lock actuator operatively connected with said lock assembly for locking or unlocking said lock assembly;

a lock knob mounted to the door;

a lock circuit including a reed switch, first circuit means for actuating said lock actuator to lock said lock assembly when said reed switch is closed, an unlock switch operatively connected with said lock knob, second circuit means for causing said lock actuator to unlock said lock assembly when said unlock switch is closed, said reed switch being mounted inside of said door near a predetermined slotless external portion of said door;

a key including a portion insertable into said key cylinder for locking or unlocking said lock assembly; and a magnet mechanically connected to a non-insertable key head portion of said key, said magnet being operative to close said reed switch when it approaches said predetermined external portion of said door from outside of said vehicle.

10. The combination as claimed in claim 9, further including a power assisted antenna device having an antenna pole, wherein said lock circuit includes means for causing said power assisted antenna device to pull down said antenna pole to a stored position thereof in response to closing of said reed switch.

11. The combination as claimed in claim 9, wherein said lock circuit includes a function switch connected in series with said reed switch.

12. The combination as claimed in claim 11, wherein said function switch is in the form of a key detecting switch which remains open as long as said key is inserted into the ignition key cylinder.

13. The combination as claimed in claim 11, wherein said function switch is in the form of a door switch which remains open until the door is completely closed.

14. In a vehicle, a combination, comprising:

a door having an inside and an outside;

a lock assembly including a key cylinder mounted within the vehicle for locking said door;

a lock actuator mounted within the vehicle and operatively connected with said lock assembly for causing said lock assembly to lock said door;

circuit means mounted within the vehicle and including a reed switch, said circuit means being operative when said reed switch is actuated to activate said lock actuator in such a direction as to cause said lock assembly to lock said door;

a key including a portion insertable into said key cylinder to lock or unlock said lock assembly;

said reed switch being mounted within the vehicle on the inside of said door; and a magnet mechanically connected to a non-insertable key head portion of said key, said reed switch being actuated by said magnet to actuate said lock actuator, thereby to cause the lock assembly to lock said door when said magnet is held near a predetermined portion of the outside of said door.

15. The combination as claimed in claim 14, wherein said lock circuit includes a timer connected in series with said reed switch to be triggered for a predetermined period of time once said reed switch is actuated, said timer being operatively connected with said lock actuator so as to provide a control arrangement wherein said reed switch is actuated by said magnet when said magnet approaches said reed switch, triggering said timer for said predetermined period of time to actuate said lock actuator during said predetermined period of time, thus causing said lock assembly to lock said door.

* * * * *